US008101328B2

(12) United States Patent
Lincoln et al.

(10) Patent No.: US 8,101,328 B2
(45) Date of Patent: Jan. 24, 2012

(54) CHARGE CONTROL AGENTS FOR TONER COMPOSITIONS

(75) Inventors: Timothy L. Lincoln, Rochester, NY (US); Timothy J. Key, Rochester, NY (US); Robert D. Bayley, Fairport, NY (US); Yuhua Tong, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 887 days.

(21) Appl. No.: 12/028,053

(22) Filed: Feb. 8, 2008

(65) Prior Publication Data

US 2009/0202931 A1 Aug. 13, 2009

(51) Int. Cl.
*G03G 9/08* (2006.01)

(52) U.S. Cl. ..... 430/108.1; 430/108.2

(58) Field of Classification Search ..... 430/108.1, 430/108.2

See application file for complete search history.

(56) References Cited

U.S. PATENT DOCUMENTS

| | | | |
|---|---|---|---|
| 2,874,063 | A | 3/1953 | Greig |
| 3,590,000 | A | 6/1971 | Palermiti et al. |
| 3,655,374 | A | 4/1972 | Palermiti et al. |
| 3,720,617 | A | 3/1973 | Chatterji et al. |
| 3,944,493 | A | 3/1976 | Jadwin et al. |
| 3,983,045 | A | 9/1976 | Jugle et al. |
| 4,007,293 | A | 2/1977 | Mincer et al. |
| 4,079,014 | A | 3/1978 | Burness et al. |
| 4,206,064 | A | 6/1980 | Kiuchi et al. |
| 4,265,990 | A | 5/1981 | Stolka et al. |
| 4,394,430 | A | 7/1983 | Jadwin et al. |
| 4,560,635 | A | 12/1985 | Hoffend et al. |
| 4,563,408 | A | 1/1986 | Lin et al. |
| 4,584,253 | A | 4/1986 | Lin et al. |
| 4,762,763 | A | 8/1988 | Nomura et al. |
| 4,935,326 | A | 6/1990 | Creatura et al. |
| 4,937,166 | A | 6/1990 | Creatura et al. |
| 5,045,423 | A | 9/1991 | Weber et al. |
| 5,079,122 | A | 1/1992 | Bayley et al. |
| 5,314,778 | A | 5/1994 | Smith et al. |
| 5,346,797 | A | 9/1994 | Kmiecik-Lawrynowicz et al. |
| 5,358,816 | A | 10/1994 | Wilson et al. |
| 5,364,729 | A | 11/1994 | Kmiecik-Lawrynowicz et al. |
| 5,403,693 | A | 4/1995 | Patel et al. |
| 5,418,108 | A | 5/1995 | Kmiecik-Lawrynowicz et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,853,943 | A | 12/1998 | Cheng et al. |
| 6,004,714 | A | 12/1999 | Ciccarelli et al. |
| 6,165,668 | A | 12/2000 | Wilson et al. |

(Continued)

FOREIGN PATENT DOCUMENTS

| | | |
|---|---|---|
| CA | 2132577 | 3/1995 |

(Continued)

OTHER PUBLICATIONS

International Search Report from corresponding European Application No. EP 09 15 0261 dated Feb. 2, 2011.

*Primary Examiner* — Hoa Le

(57) ABSTRACT

The present disclosure provides polymer-ionic complexes useful as charge control agents. Such charge control agents may be utilized with toner particles to impart excellent triboelectric charging characteristics to the toner.

9 Claims, 1 Drawing Sheet

U.S. PATENT DOCUMENTS

| | | | |
|---|---|---|---|
| 6,190,815 | B1 | 2/2001 | Ciccarelli et al. |
| 6,221,550 | B1 | 4/2001 | Wilson et al. |
| 6,562,535 | B1 | 5/2003 | Masuo et al. |
| 6,652,634 | B1 | 11/2003 | Akers et al. |
| 7,147,979 | B2 | 12/2006 | Kidokoro |
| 7,300,736 | B2 | 11/2007 | Fushimi et al. |
| 2003/0175607 | A1 | 9/2003 | Isoda et al. |
| 2003/0180642 | A1 | 9/2003 | Isoda et al. |
| 2003/0191263 | A1 | 10/2003 | Yoshida et al. |
| 2004/0002014 | A1 | 1/2004 | Chae et al. |
| 2005/0277040 | A1 | 12/2005 | Michel et al. |
| 2006/0014921 | A1* | 1/2006 | Mihara et al. ..... 528/272 |
| 2006/0287473 | A1* | 12/2006 | Fukui et al. ..... 528/272 |
| 2006/0292471 | A1 | 12/2006 | Isoda et al. |
| 2007/0117945 | A1 | 5/2007 | Minami et al. |

FOREIGN PATENT DOCUMENTS

| | | | |
|---|---|---|---|
| EP | 1 383 011 | A1 | 1/2004 |
| EP | 1 426 830 | A1 | 6/2004 |
| EP | 1 579 276 | B1 | 8/2006 |
| WO | WO 96/20436 | A1 | 7/1996 |

* cited by examiner

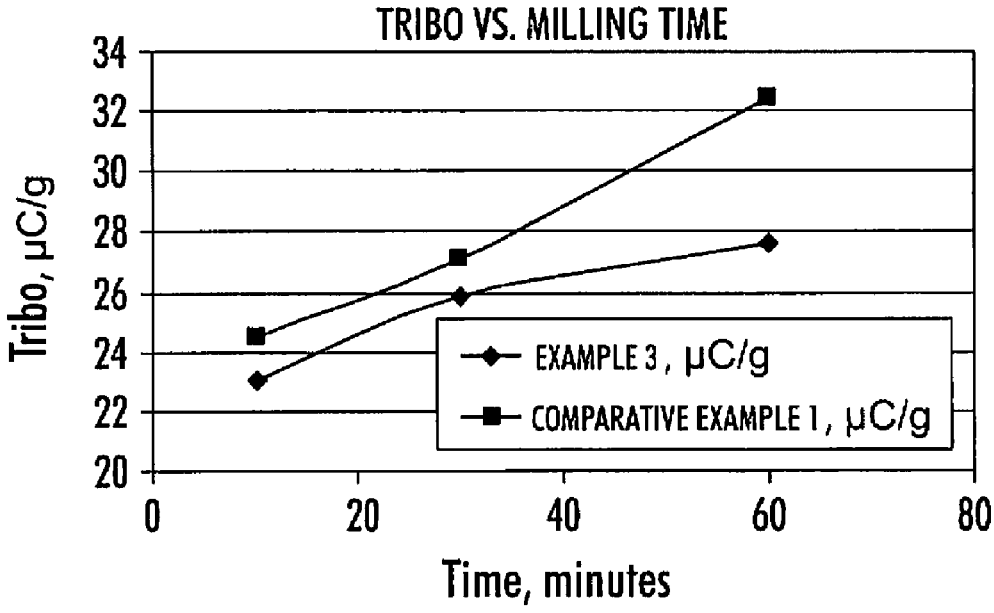
FIGURE

CHARGE CONTROL AGENTS FOR TONER COMPOSITIONS

BACKGROUND

The present disclosure relates to toners and processes useful in providing toners suitable for electrostatographic apparatuses, including xerographic apparatuses such as digital, image-on-image, and similar apparatuses.

Numerous processes are within the purview of those skilled in the art for the preparation of toners. Emulsion aggregation (EA) is one such method whereby toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Toner systems normally fall into two classes: two component systems, in which the developer material includes magnetic carrier granules having toner particles adhering triboelectrically thereto; and single component systems (SDC), which typically use only toner. Placing charge on the particles, to enable movement and development of images via electric fields, is most often accomplished with triboelectricity. Triboelectric charging may occur either by mixing the toner with larger carrier beads in a two component development system or by rubbing the toner between a blade and donor roll in a single component system.

Charge control agents may be utilized to enhance triboelectric charging. Such agents may be applied to toner particle surfaces by a blending process. Charge control agents may be organic salts. Such charge control agents may be used in small amounts of from about 0.01 weight percent to about 5 weight percent of the toner to control both the polarity of charge on a toner and the distribution of charge on a toner. Although the amount of charge control agents may be small compared to other components of a toner, charge control agents may be important for triboelectric charging properties of a toner. These triboelectric charging properties, in turn, may impact imaging speed and quality. Examples of charge control agents include those found in EP Patent Application No. 1426830, U.S. Pat. No. 6,652,634, EP Patent Application No. 1383011, U.S. Patent Application Publication No. 2004/002014, U.S. Patent Application Publication No. 2003/191263, U.S. Pat. No. 6,221,550, and U.S. Pat. No. 6,165,668.

The application of charge control agents by traditional methods may result in non-uniformity of charge and poor incorporation of the charge control agent with the binder resin of the toner, which may cause unstable triboelectric charging and poor imaging quality.

Improved methods for producing toner, which permits excellent control of the charging of toner particles, remain desirable.

SUMMARY

The present disclosure provides charge control agents suitable for use with toners and toners possessing such charge control agents. In embodiments, a toner of the present disclosure may include a toner particle including a latex, a pigment, an optional wax, and a charge control agent including a polymer-ionic complex. The polymer-ionic complex utilized as the charge control agent may include an ion such as metallic ions and non-metallic ions, in combination with a polymeric ligand having an average molecular weight of from about 2000 to about 200000, the polymeric ligand including an acid such as salicylic acid, naphthoic acid, dicarboxylic acid, sulfonic acid, phosphoric acid, and combinations thereof, in combination with a second component such as aldehydes, amino compounds, halogenated compounds, phosphine compounds, hydroxyl compounds, diketone compounds, and combinations thereof.

In embodiments, a toner of the present disclosure may include a toner particle including a latex, a pigment, an optional wax, and a charge control agent including a polymer-ionic complex. The polymer-ionic complex may include an ion including metallic ions and non-metallic ions, in combination with a polymeric ligand having an average molecular weight of from about 2000 to about 200000. The polymeric ligand may include an acid such as salicylic acid, naphthoic acid, dicarboxylic acid, sulfonic acid, phosphoric acid, and combinations thereof, in combination with an aldehyde such as formaldehyde, paraformaldehyde, acetaldehyde, dodecyl aldehyde, octanal, hexanal, valeraldehyde, butyraldehyde, and combinations thereof.

In other embodiments, the present disclosure provides charge control agents including a polymer-ionic complex. The polymer-ionic complex may include an ion such as metallic ions and non-metallic ions, and a polymeric ligand having an average molecular weight of from about 2000 to about 200000. The polymeric ligand may include an acid such as salicylic acid, naphthoic acid, dicarboxylic acid, sulfonic acid, phosphoric acid, and combinations thereof, in combination with a second component including aldehydes, amino compounds, halogenated compounds, phosphine compounds, hydroxyl compounds, diketone compounds, and combinations thereof.

BRIEF DESCRIPTION OF THE DRAWINGS

Various embodiments of the present disclosure will be described herein below with reference to the FIGURES wherein:

The FIGURE is a graph depicting the triboelectric charge of a toner of the present disclosure as a function of milling time compared with a control toner.

DETAILED DESCRIPTION OF EMBODIMENTS

The present disclosure provides charge control agents for toners and processes for the preparation of toner particles having excellent charging characteristics. Toners of the present disclosure may, in embodiments, include polymer-ionic complexes as charge control agents. As used herein, a "polymer-ionic complex" may include for example, in embodiments, a polymeric component including a carboxylic acid in combination with another component, the polymeric component having an average molecular weight greater than about 1000, in embodiments from about 2000 to about 200,000, in other embodiments from about 5000 to about 100,000, in combination with ions including metallic ions and/or non-metallic ions. This is different from conventional small molecular charge control agents, which have an average molecular weight that is less than about 1000.

The polymer-ionic complex charge control agents described herein may be utilized with any toner within the purview of those skilled in the art. In embodiments the charge control agents described herein may be utilized with conventional toners produced by melt-mixing resins and colorants, forming agglomerated particles, and grinding or similarly treating the agglomerated particles to form toner particles. In other embodiments, the charge control agents described herein may be utilized with toners produced by chemical synthesis methods, including emulsion aggregation toners.

Toners of the present disclosure may include a latex resin in combination with a pigment. While the latex resin may be prepared by any method within the purview of those skilled in the art, in embodiments the latex resin may be prepared by emulsion polymerization methods, including semi-continuous emulsion polymerization, and the toner may include emulsion aggregation toners. Emulsion aggregation involves aggregation of both submicron latex and pigment particles into toner size particles, where the growth in particle size is, for example, in embodiments from about 0.1 micron to about 15 microns.

Resin

Any monomer suitable for preparing a latex for use in a toner may be utilized. Such latexes may be produced by conventional methods. As noted above, in embodiments the toner may be produced by emulsion aggregation. Suitable monomers useful in forming a latex emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the resin of the latex may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly(styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymer may be block, random, or alternating copolymers. In addition, polyester resins obtained from the reaction products of bisphenol A and propylene oxide or propylene carbonate, and in particular including such polyesters followed by the reaction of the resulting product with fumaric acid (as disclosed in U.S. Pat. No. 5,227,460, the disclosure of which is hereby incorporated by reference in its entirety), and branched polyester resins resulting from the reaction of dimethylterephthalate with 1,3-butanediol, 1,2-propanediol, and pentaerythritol, may also be used.

In embodiments, a poly(styrene-butyl acrylate) may be utilized as the latex. The glass transition temperature of this latex may be from about 35° C. to about 75° C., in embodiments from about 40° C. to about 70° C.

Surfactants

In embodiments, the latex may be prepared in an aqueous phase containing a surfactant or co-surfactant. Surfactants which may be utilized with the resin to form a latex dispersion can be ionic or nonionic surfactants in an amount of from about 0.01 to about 15 weight percent of the solids, and in embodiments of from about 0.1 to about 10 weight percent of the solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, combinations thereof, and the like. In embodiments commercially available surfactants from Rhone-Poulenc such as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

Initiators

In embodiments initiators may be added for formation of the latex. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine]tetrahydrochloride, 2,2'-azobis[2-methyl-N(phenylmethyl)propionamidine]dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane]dihydrochloride, 2,2'-azobis[2-(3,4,5,6-tetrahy dropyri midin-2-yl) propane]dihydrochloride, 2,2'-azobis[2-(5-hydroxy-3,4,5,6-tetrahydropyrimidin-2-yl)propane]dihydrochloride, 2,2'-azobis{2-[1-(2-hydroxyethyl)-2-imidazolin-2-yl] propane}dihydrochloride, combinations thereof, and the like.

Initiators can be added in suitable amounts, such as from about 0.1 to about 8 weight percent, and in embodiments of from about 0.2 to about 5 weight percent of the monomers.

Chain Transfer Agents

In embodiments, chain transfer agents may also be utilized in forming the latex. Suitable chain transfer agents include dodecane thiol, octane thiol, carbon tetrabromide, combinations thereof, and the like, in amounts from about 0.1 to about 10 percent and, in embodiments, from about 0.2 to about 5 percent by weight of monomers, to control the molecular weight properties of the polymer when emulsion polymerization is conducted in accordance with the present disclosure.

Stabilizers

In embodiments, it may be advantageous to include a stabilizer when forming the latex particles. Suitable stabilizers include monomers having carboxylic acid functionality. Such stabilizers may be of the following formula (I):

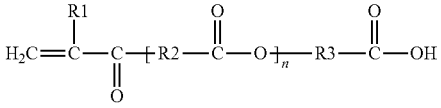

(I)

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such stabilizers include beta carboxyethyl acrylate (β-CEA), poly(2-carboxyethyl)acrylate, 2-carboxyethyl methacrylate, combinations thereof, and the like. Other stabilizers which may be utilized include, for example, acrylic acid and its derivatives.

In embodiments, the stabilizer having carboxylic acid functionality may also contain a small amount of metallic ions, such as sodium, potassium and/or calcium, to achieve better emulsion polymerization results. The metallic ions may be present in an amount from about 0.001 to about 10 percent by weight of the stabilizer having carboxylic acid functionality, in embodiments from about 0.5 to about 5 percent by weight of the stabilizer having carboxylic acid functionality.

Where present, the stabilizer may be added in amounts from about 0.01 to about 5 percent by weight of the toner, in embodiments from about 0.05 to about 2 percent by weight of the toner.

Additional stabilizers that may be utilized in the toner formulation processes include bases such as metal hydroxides, including sodium hydroxide, potassium hydroxide, ammonium hydroxide, and optionally combinations thereof. Also useful as a stabilizer is sodium carbonate, sodium bicarbonate, calcium carbonate, potassium carbonate, ammonium carbonate, combinations thereof, and the like. In embodiments a stabilizer may include a composition containing sodium silicate dissolved in sodium hydroxide.

pH Adjustment Agent

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof.

Reaction Conditions

In the emulsion aggregation process, the reactants may be added to a suitable reactor, such as a mixing vessel. The appropriate amount of at least two monomers, in embodiments from about two to about ten monomers, stabilizer, surfactant(s), initiator, if any, chain transfer agent, if any, and wax, if any, and the like may be combined in the reactor and the emulsion aggregation process may be allowed to begin. Suitable waxes are described in greater detail below as a component to be added in the formation of a toner particle; such waxes may also be useful, in embodiments, in forming a latex. Reaction conditions selected for effecting the emulsion polymerization include temperatures of, for example, from about 45° C. to about 120° C., in embodiments from about 60° C. to about 90° C. In embodiments the polymerization may occur at elevated temperatures within about 10 percent of the melting point of any wax present, for example from about 60° C. to about 85° C., in embodiments from about 65° C. to about 80° C., to permit the wax to soften thereby promoting dispersion and incorporation into the emulsion.

Nanometer size particles may be formed, from about 50 nm to about 800 nm in volume average diameter, in embodiments from about 100 nm to about 400 nm in volume average diameter, as determined, for example, by a Brookhaven nanosize particle analyzer.

After formation of the latex particles, the latex particles may be utilized to form a toner. In embodiments, the toners may be an emulsion aggregation type toner that are prepared by the aggregation and fusion of the latex particles of the present disclosure with a colorant, and one or more additives such as surfactants, coagulants, waxes, surface additives, and optionally combinations thereof.

The latex particles may be added to a colorant dispersion. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. In embodiments, the surfactant may be ionic and may be from about 1 to about 25 percent by weight, and in embodiments from about 4 to about 15 percent by weight, of the colorant.

Colorants

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or combinations thereof. In embodiments a pigment may be utilized. As used herein, a pigment includes a material that changes the color of light it reflects as the result of selective color absorption. In embodiments, in contrast with a dye which may be generally applied in an aqueous solution, a pigment generally is insoluble. For example, while a dye may be soluble in the carrying vehicle (the binder), a pigment may be insoluble in the carrying vehicle.

In embodiments wherein the colorant is a pigment, the pigment may be, for example, carbon black, phthalocyanines, quinacridones, red, green, orange, brown, violet, yellow, fluorescent colorants including RHODAMINE B™ type, and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, copper tetra(octadecyl sulfonamido)phthalocyanine, x-copper phthalocyanine pigment listed in the Color Index as Cl 74160, Cl Pigment Blue, Anthrathrene Blue identified in the Color Index as Cl 69810, Special Blue X-2137, diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 18 weight percent of the toner.

In embodiments, colorant examples include Pigment Blue 15:3 having a Color Index Constitution Number of 74160, Magenta Pigment Red 81:3 having a Color Index Constitution Number of 45160:3, Yellow 17 having a Color Index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant. Pigment Red 122 (sometimes referred to herein as PR-122) has been widely used in the pigmentation of toners, plastics, ink, and coatings, due to its unique magenta shade. The chemical structures of PR-122, Pigment Red 269, and Pigment Red 185 (sometimes referred to herein as PR-185) are set forth below.

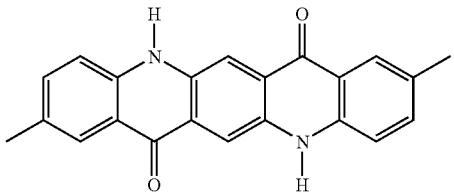

Pigment PR 122 (2,9-dimethylquinacridone)

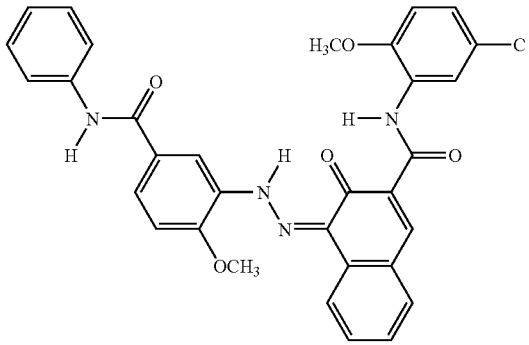

Pigment Red 269

-continued

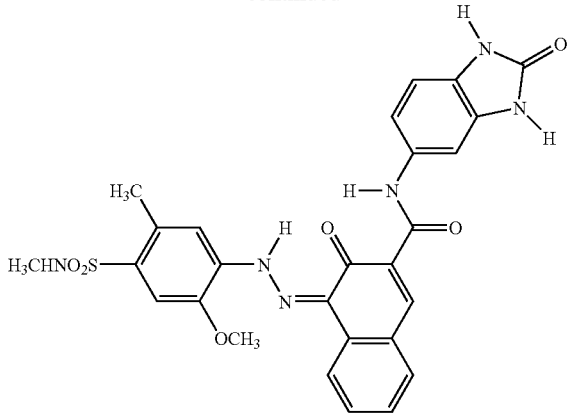

Pigment Red 185

Coagulants

In embodiments, a coagulant may be added during or prior to aggregating the latex and the aqueous colorant dispersion. The coagulant may be added over a period of time from about 1 minute to about 60 minutes, in embodiments from about 1.25 minutes to about 20 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to contain the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.01 to about 5 percent by weight of the toner, and in embodiments from about 0.1 to about 3 percent by weight of the toner.

Wax

Wax dispersions may also be added during formation of a latex or toner in an emulsion aggregation synthesis. Suitable waxes include, for example, submicron wax particles in the size range of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 0.5 to about 15 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasel K.K., and similar materials. In embodiments, commercially available polyethylene waxes possess a molecular weight (Mw) of from about 100 to about 5000, and in embodiments of from about 250 to about 2500, while the commercially available polypropylene waxes have a molecular weight of from about 200 to about 10,000, and in embodiments of from about 400 to about 5000.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, JONCRYL 74, 89, 130, 537, and 538, all available from Johnson Diversey, Inc, or chlorinated polypropylenes and polyethylenes commercially available from Allied Chemical, Baker Petrolite Corporation and Johnson Diversey, Inc.

The wax may be present in an amount of from about 0.1 to about 30 percent by weight, and in embodiments from about 2 to about 20 percent by weight of the toner.

Aggregating Agents

Any aggregating agent capable of causing complexation might be used in forming toner of the present disclosure. Both alkali earth metal or transition metal salts can be utilized as aggregating agents. In embodiments, alkali (II) salts can be selected to aggregate sodium sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like.

The resultant blend of latex, optionally in a dispersion, colorant dispersion, optional wax, optional coagulant, and optional aggregating agent, may then be stirred and heated to a temperature below the Tg of the latex, in embodiments from about 30° C. to about 70° C., in embodiments of from about 40° C. to about 65° C., for a period of time from about 0.2 hours to about 6 hours, in embodiments from about 0.3 hours to about 5 hours, resulting in toner aggregates of from about 3 microns to about 15 microns in volume average diameter, in embodiments of from about 4 microns to about 8 microns in volume average diameter.

In embodiments, a shell may be formed on the aggregated particles. Any latex utilized noted above to form the latex resin may be utilized to form the shell latex. In embodiments, a styrene-n-butyl acrylate copolymer may be utilized to form the shell latex. In embodiments, the latex utilized to form the shell may have a glass transition temperature of from about 35° C. to about 75° C., in embodiments from about 40° C. to about 70° C.

Where present, a shell latex may be applied by any method within the purview of those skilled in the art, including dipping, spraying, and the like. The shell latex may be applied until the desired final size of the toner particles is achieved, in embodiments from about 3 microns to about 12 microns, in other embodiments from about 4 microns to about 8 microns.

Once the desired final size of the toner particles is achieved, the pH of the mixture may be adjusted with a base to a value of from about 3.5 to about 7, and in embodiments from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 15 percent by weight of the mixture.

The mixture of latex, colorant and optional wax is subsequently coalesced. Coalescing may include stirring and heating at a temperature of from about 80° C. to about 99° C., in embodiments from about 85° C. to about 98° C., for a period of from about 0.5 hours to about 12 hours, and in embodiments from about 1 hour to about 6 hours. Coalescing may be accelerated by additional stirring.

The pH of the mixture may then be lowered to from about 3.5 to about 6, in embodiments from about 3.7 to about 5.5, with, for example, an acid to coalesce the toner aggregates. Suitable acids include, for example, nitric acid, sulfuric acid, hydrochloric acid, citric acid or acetic acid. The amount of acid added may be from about 0.1 to about 30 percent by weight of the mixture, and in embodiments from about 1 to about 20 percent by weight of the mixture.

The mixture is cooled in a cooling or freezing step. Cooling may be at a temperature of from about 20° C. to about 40° C., in embodiments from about 22° C. to about 30° C. over a period time from about 1 hour to about 8 hours, and in embodiments from about 1.5 hours to about 5 hours.

In embodiments, cooling a coalesced toner slurry includes quenching by adding a cooling media such as, for example, ice, dry ice and the like, to effect rapid cooling to a temperature of from about 20° C. to about 40° C., and in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may not be feasible or practical, neither by the introduction of a cooling medium into the toner mixture, nor by the use of jacketed reactor cooling.

After this cooling, the aggregate suspension may be heated to a temperature at or above the Tg of the latex. Where the particles have a core-shell configuration, heating may be above the Tg of the first latex used to form the core and the Tg of the second latex used to form the shell, to fuse the shell latex with the core latex. In embodiments, the aggregate suspension may be heated to a temperature of from about 80° C. to about 120° C., in embodiments from about 85° C. to about 98° C., for a period of time from about 1 hour to about 6 hours, in embodiments from about 2 hours to about 4 hours.

The toner slurry may then be washed. Washing may be carried out at a pH of from about 7 to about 12, and in embodiments at a pH of from about 9 to about 11. The washing may be at a temperature of from about 30° C. to about 70° C., and in embodiments from about 40° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes.

Drying may be carried out at a temperature of from about 35° C. to about 75° C., and in embodiments of from about 45° C. to about 60° C. The drying may be continued until the moisture level of the particles is below a set target of about 1% by weight, in embodiments of less than about 0.7% by weight.

Charge Control Agents

As noted above, in embodiments toners of the present disclosure may include charge control agents. The surface of toner particles produced by emulsion aggregation may possess numerous electron accepter carbonyl groups, including carboxylic acids and esters. In accordance with the present disclosure, charge control agents may be provided which possess groups capable of hydrogen bonding and/or polar-polar interactions with these carbonyl groups on the toner particle surface.

Suitable charge control agents for use in accordance with the present disclosure include polymer-ionic complexes. In embodiments, the polymeric component, sometimes referred to herein, in embodiments, as a polymeric ligand, of a polymer-ionic complex may be formed by combining an acid with a second component such as an aldehyde, an amino compound, halogenated compounds, phosphine compounds, hydroxyl compounds, diketone compounds, combinations thereof, and the like.

Suitable acids which may be utilized in forming the polymeric ligand of the polymer-ionic complexes include, but are not limited to, those possessing carboxylic acid functionality, such as salicylic acid, naphthoic acid, dicarboxylic acid, sulfonic acid, phosphoric acid, combinations thereof, and the like.

Suitable aldehydes which may be utilized as the second component in forming the polymeric ligand of these metallic complexes include, but are not limited to, formaldehyde, paraformaldehyde, acetaldehyde, dodecyl aldehyde, octanal, hexanal, valeraldehyde, butyraldehyde, combinations thereof, and the like.

Suitable amino compounds which may be utilized as the second component in forming the polymeric ligand of these complexes include, but are not limited to, triethylamines, triphenylamines, pyridine compounds, imidazole compounds, diphenylamine compounds, alkylamine compounds, combinations thereof, and the like.

Suitable halogenated compounds which may be utilized as the second component in forming the polymeric ligand of these complexes include, but are not limited to benzyl chloride compounds, butyl bromide, methyl iodide, cyclohexyl bromide, combinations thereof, and the like.

Suitable phosphine compounds include, but are not limited to, triphenylphosphine, Diphenyl(p-tolyl)phosphine, Triisobutylphosphine, Tris(2,4,6-trimethylphenyl)phosphine, Tris[3,5-bis(trifluoromethyl)phenyl]phosphine, Tris(4-chlorophenyl)phosphine, Tris(diethylamino)phosphine, Tris(hydroxymethyl)phosphine, Tris(trimethylsilyl)phosphine, combinations thereof, and the like.

Suitable hydroxyl compounds include, but are not limited to, phenol, (2-chlorophenyl)ethane-1,2-diol, 2-bromo-1-indanol, 2-bromoethanol, citric acid, glycolic acid, glycerol, combinations thereof, and the like.

Suitable diketone compounds include, but are not limited to, acetoacetanilide, 2-acetoacetoxyethyl methacrylate, ethyl acetoacetate, combinations thereof, and the like.

Methods for forming the polymeric ligand are within the purview of those skilled in the art. In embodiments, for example, an acid such as salicylic acid may be combined with an aldehyde such as paraformaldehyde in the presence of water and a catalyst such as oxalic acid, acetic acid, phosphoric acid, sulfuric acid, succinic acid, citric acid, combinations thereof, and the like, and mixed. The mixture may be heated to a temperature of from about 5° C. to about 100° C., in embodiments from about 15° C. to about 75° C., for a period of time of from about 15 minutes to about 2 hours, in embodiments from about 30 minutes to about 1.5 hours, in embodiments about 1 hour. After that time, an acid such as HCl may be added, optionally in water, with stirring for an additional period of time from about 4 hours to about 8 hours, in embodiments from about 5 hours to about 7 hours, and cooled, in embodiments to a temperature of from about 20° C. to about 25° C. The resulting solution may be filtered or treated by any similar method within the purview of those skilled in the art and the resulting precipitate, which is the polymeric ligand, may be collected.

Once the above polymeric ligand has been formed, it may be combined with an ion to produce a polymer-ionic complex. Suitable ions which may be utilized to form the polymer-ionic complex include metallic and non-metallic ions.

In embodiments, metallic ions may be utilized to form the polymer-ionic complex suitable for use as a charge control agent of the present disclosure. Suitable metallic ions include, but are not limited to, zinc, nickel, cobalt, copper, chromium, iron, aluminum, boron, gallium, manganese, tin, lead, combinations thereof, and the like. In embodiments, a metal salt including the above metallic ions may be reacted with the polymeric ligand by methods within the purview of those skilled in the art thereby forming a chelate of the metallic ion with the polymeric ligand.

In other embodiments, the polymeric ligand may be combined with a non-metallic ion to produce a polymer-ionic complex suitable for use as a charge control agent of the present disclosure. In embodiments, the non-metallic ion may be a cation. Suitable non-metallic cations which may be utilized include, but are not limited to, ammonium, phosphonium, oxazolinium, pyridinium, combinations thereof, and the like. In embodiments, a salt including the above non-metallic ions may be reacted with the polymeric ligand by methods within the purview of those skilled in the art thereby forming a polymer-ionic complex of the non-metallic ion with the polymeric ligand.

As noted above, methods for forming the polymer-ionic complex are within the purview of those skilled in the art. In embodiments, for example, where the ion portion of the polymer-ionic complex is metallic, the polymeric ligand may be contacted with a metal salt and stirred at a temperature of from about 20° C. to about 25° C. for a period of time from about 18 hours to about 30 hours, in embodiments from about 22 hours to about 26 hours, in embodiments about 24 hours, to obtain a polymer-ionic complex of the present disclosure which is suitable for use as a charge control agent.

In embodiments, for example, where the ion portion of the polymer-ionic complex is non-metallic, the polymeric ligand may be contacted with a non-metal salt and stirred at a temperature of from about 5° C. to about 100° C. for a period of time from about 0.5 hours to about 48 hours, in embodiments from about 2 hours to about 36 hours, in embodiments about 24 hours, to obtain a polymer-ionic complex of the present disclosure which is suitable for use as a charge control agent.

An overview of the reaction scheme for forming a polymer-ionic complex is illustrated below where an acid utilized to form the polymeric ligand is salicylic acid, an aldehyde utilized to form the polymeric ligand is formaldehyde, and a metal salt utilized to form the polymer-ionic complex for use as a charge control agent is zinc chloride:

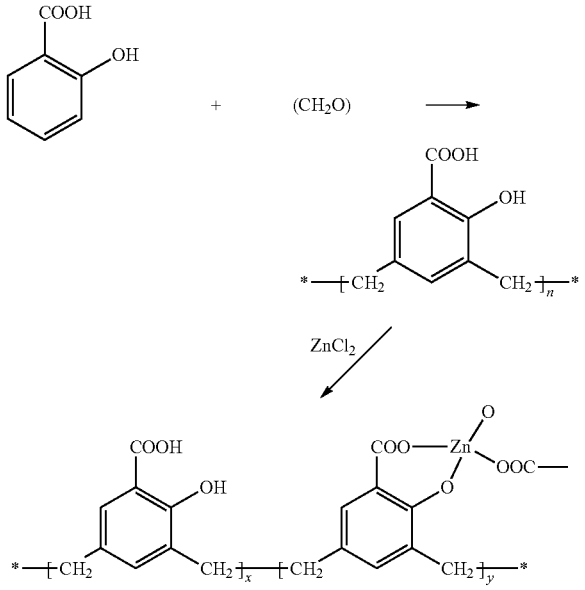

wherein n is a number from about 5 to about 1000, in embodiments from about 10 to about 750; x is a number from about 5 to about 1000, in embodiments from about 10 to about 500; and y is a number from about 5 to about 1000, in embodiments from about 10 to about 500.

As noted above, in other embodiments, a polymer complex may be formed and combined with a non-metallic ion. An example of one such complex is as follows:

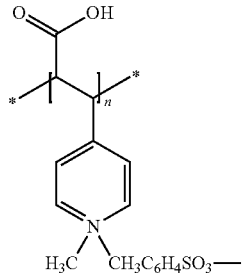

which is a complex of poly(4-pyridylacetic acid) and methyl p-toluenesulfonate, where n is from 5 to 1000, in embodiments from about 10 to about 750. The above complex may, in embodiments, be combined with any non-metallic ion noted above.

In embodiments, a polymer-ionic complex of the present disclosure may be of the following formula:

$$P—X—(R)_n$$

where X is a metallic or non-metallic ion, P is the portion of the polymer derived from the component possessing carboxylic acid functional groups with P having an average molecular weight greater than about 1000, R is the portion of the polymer derived from a component such as halogen, amino, hydroxyl, C1-C24 alkyl, C1-C24 alkoxy, carboxy, nitro, cyano, and/or sulfo, with a molecular weight less than about 1000, and n is from about 0 to about 20, in embodiments from about 1 to about 10.

In embodiments, a polymeric ionic complex of the present disclosure may include a complex of salicylic acid-formaldehyde copolymer and zinc chloride; a complex of 4-tert-butyl salicylic acid-formaldehyde copolymer and zinc chloride, a complex of salicylic acid-acetaldehyde copolymer and zinc chloride, a complex of salicylic acid-formaldehyde copolymer and aluminum chloride, and a complex of salicylic acid-formaldehyde copolymer and iron chloride.

In embodiments, a polymeric complex of the present disclosure may include a complex of poly(4-vinylpyridine) and methyl p-toluenesulfonate; a complex of poly(4-vinylpyridine) and methyl iodide; a complex of poly(4-vinylpyridine) and butyl bromide; a complex of poly(4-vinylpyridine) and benzyl chloride; a complex of poly(dimethyl 4-vinylphenylamine) and benzyl bromide; and a complex of poly(diphenyl 4-vinylphenylphosphine) and cyclohexyl bromide. The above complexes may, in embodiments, be combined with any non-metallic ion noted above to form a polymeric ionic complex of the present disclosure.

When charge control agents like the polymer-ionic complexes of the present disclosure contain free polar functional groups like COOH and OH, strong hydrogen bonding and polar-polar interaction between the charge control agent and toner particles can form, especially where, as noted above, the surface of the toner particles possesses electron accepter carbonyl groups, including carboxylic acids and esters, which may be present on toner particles formed by emulsion aggregation methods. This strong interaction may not only enhance the charge transfer/ion transfer in surface friction, which can lead to excellent triboelectric charging, but also improve the ability of the charge control agent particles to be incorporated on and/or adhere to the surface of the toner, thereby providing a stable triboelectric charge on the toner particle, and reduce the amount of charge control agent necessary to obtain a desired triboelectric charge.

The chemical interaction of the charge control agents herein with the toner particles may also result in excellent charging efficiency, and thus low amounts of charge control agents of the present disclosure may be required to obtain a desired triboelectric charge as compared with conventional toners.

The polymer-ionic complexes utilized as charge control agents may be present in effective amounts of, for example, from about 0.001 to about 20 weight percent of the toner, in embodiments from about 0.01 to about 10 weight percent of the toner.

The toner may also include other charge additives in effective amounts of, for example, from about 0.01 to about 10 weight percent of the toner, in embodiments from about 0.05 to about 7 weight percent of the toner. Additional suitable charge additives include alkyl pyridinium halides, bisulfates, the charge control additives of U.S. Pat. Nos. 3,944,493; 4,007,293; 4,079,014; 4,394,430 and 4,560,635, the disclosures of each of which are hereby incorporated by reference in their entirety, negative charge enhancing additives like aluminum complexes, any other charge additives, combinations thereof, and the like.

Charge control agents such as the polymer-ionic complexes of the present disclosure may be combined with toner particles utilizing any method within the purview of those skilled in the art, including blending, mixing, paint shaking, sonication, coating, grafting, combinations thereof, and the like for a suitable period of time from about 5 minutes to about 180 minutes, in embodiments from about 10 minutes to about 60 minutes.

The triboelectric charge on toner particles of the present disclosure utilizing the charge control agents described above may be from about 5 μC/g to about 100 μC/g, in embodiments from about 20 μC/g to about 60 μC/g, depending, in part, upon the length of time the polymer-ionic complexes and toner particles are combined, as well as the materials utilized to form the polymer-ionic complexes and the toner particles. The interaction of polymer-ionic complexes of the present disclosure and toner particles should be strong and stable during milling to provide stable triboelectric charging behavior.

As noted above, the free carboxylic acid and hydroxyl groups on a resin formed by emulsion aggregation can have excellent attraction to the polymer-ionic complex charge control agents of the present disclosure. The amount of ions present on the polymer-ionic complex for attraction to the free carboxylic acid and hydroxyl groups may be adjusted by controlling the amount of ions, metallic or non-metallic, that are added to form the complex. Thus, the attraction of the polymer-ionic complex charge control agent to free carboxylic acid groups and hydroxyl groups is tunable, which may enable the polymeric charge control agents of the present disclosure to be used with different types of toners.

The toner particles possessing polymer-ionic complexes as charge control agents may have excellent compatibility with other resins and pigments. Resulting toner particles have excellent triboelectric robustness, for example the ability to retain a uniform triboelectric charge. This ability to retain a uniform triboelectric charge may help reduce the number of toner failure modes in an apparatus utilizing such a toner, and also increase productivity and reduce the unit manufacturing cost (UMC) for the toner by reducing the time required to produce the toner, as well as reducing the need for additional processing or other additives to obtain suitable toner particles.

Other Additives

Further optional additives which may be combined with a toner include any additive to enhance the properties of toner compositions. Included are surface additives, color enhancers, etc. Surface additives that can be added to the toner compositions after washing or drying include, for example, metal salts, metal salts of fatty acids, colloidal silicas, metal oxides, strontium titanates, combinations thereof, and the like, which additives are each usually present in an amount of from about 0.1 to about 10 weight percent of the toner, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 percent by weight of the toner, in embodiments from about 0.1 to about 2 percent by weight of the toner. These additives can be added during the aggregation or blended into the formed toner product.

Toner particles produced utilizing a latex of the present disclosure may have a size of about 1 micron to about 20 microns, in embodiments about 2 microns to about 15 microns, in embodiments about 3 microns to about 7 microns. Toner particles of the present disclosure may have a circularity of from about 0.9 to about 0.99, in embodiments from about 0.92 to about 0.98.

Following the methods of the present disclosure, toner particles may be obtained having several advantages compared with conventional toners: (1) increase in the robustness of the particles' triboelectric charging, which reduces the toner defects and improves the machine performance; (2) easy to implement, no major changes to existing aggregation/coalescence processes; (3) and increase in productivity and reduction in unit manufacturing cost (UMC) by reducing the production time and the need for rework (quality yield improvement).

Uses

Toner in accordance with the present disclosure can be used in a variety of imaging devices including printers, copy machines, and the like. The toners generated in accordance with the present disclosure are excellent for imaging processes, especially xerographic processes and are capable of providing high quality colored images with excellent image resolution, acceptable signal-to-noise ratio, and image uniformity. Further, toners of the present disclosure can be selected for electrophotographic imaging and printing processes such as digital imaging systems and processes.

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the disclosures of each of which are hereby incorporated by reference in their entirety. The carriers may be present from about 2 percent by weight of the toner to about 8 percent by weight of the toner, in embodiments from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, combinations thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer includes conductive carrier particles and is capable of conducting an electric current between the biased magnet through the carrier particles to the photoreceptor.

Imaging

Imaging methods are also envisioned with the toners disclosed herein. Such methods include, for example, some of the above patents mentioned above and U.S. Pat. Nos. 4,265,990, 4,584,253 and 4,563,408, the disclosures of each of which are hereby incorporated by reference in their entirety. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

Synthesis of salicylic acid and formaldehyde copolymer. About 95 grams of salicylic acid, about 20.65 grams of paraformaldehyde, about 350 grams of water and about 1 gram of oxalic acid as a catalyst were mixed and heated to refluxing for about 1 hour. About 52 ml of concentrated HCl and about 60 ml of water were added. The mixture was stirred and kept refluxing for about 6 hours. The mixture was then cooled to room temperature, at which time the solution was filtered to collect the white precipitate. The precipitate was then washed 3 times with about 300 ml of water, and dried.

Example 2

Formation of a polymer-ionic complex. About 7.2 g of the copolymer produced in Example 1 above was dissolved in about 37 ml of 1 N NaOH and about 200 ml of methanol. A mixture of about 200 grams water and about 4.18 grams zinc chloride was added to this solution, with about 5 drops of concentrated HCl solution added dropwise. The resulting mixture was stirred at room temperature for about 24 hours. The precipitate was collected by filtration, and washed 3 times in about 100 ml of water. The resulting polymer-ionic complex product was dried by a freezing-dryer.

Example 3

Latex preparation. An emulsion aggregation magenta toner was prepared as follows. A monomer emulsion was prepared by agitating a monomer mixture (about 630 grams of styrene, about 140 grams of n-butyl acrylate, about 23.2 grams of beta-carboxyethyl acrylate (β-CEA) and about 5.4 grams of 1-dodecanethiol) with an aqueous solution (about 15.3 grams of DOWFAX 2A1 (an alkyldiphenyloxide disulfonate surfactant from Dow Chemical), and about 368 grams of deionized water) at about 300 revolutions per minute (rpm) at a temperature from about 20° C. to about 25° C.

About 1.1 grams of DOWFAX 2A1 (about 47% aqueous) and about 736 grams of deionized water were charged in a 2 liter jacketed stainless steel reactor with double P-4 impellers set at about 300 rpm, and deaerated for about 30 minutes while the temperature was raised to about 75° C.

About 11.9 grams of the monomer emulsion described above was then added into the stainless steel reactor and was stirred for about 8 minutes at about 75° C. An initiator solution prepared from about 11.6 grams of ammonium persulfate in about 57 grams of deionized water was added to the reactor over about 20 minutes. Stirring continued for about an additional 20 minutes to allow seed particle formation. About 407 grams of the remaining monomer emulsion was fed into the reactor over about 130 minutes. A latex having a particle size of about 150 nm was formed at this point, with a Mw of about 50 kg/mole (as determined by gel permeation chromatography (GPC)). After waiting about 20 minutes, the rest of the monomer solution was added over a period of about 90 minutes. After the addition, the latex was stirred at the same temperature for about 3 more hours. The final latex particle size was about 220 nm, having a molecular weight of about 38,000.

Toner particle preparation. About 225 grams of the latex was combined with about 50 grams of a PR-122 pigment dispersion, about 8.7 grams of a PR-185 pigment dispersion (from Sun Chemicals Co.), about 30.1 grams of a polyethylene wax POLYWAX 725® dispersion (Mw of about 725, about 31 percent active, available from Baker Petrolite Company), and about 1000 ml of deionized water. The components were mixed with a homogenizer at about 22° C. for about 8 minutes. The reaction temperature was then raised to about 59° C., at which point the particle size was about 6.2 microns.

About 105 grams of the latex prepared above was then added dropwise. After the addition of the latex, the resulting slurry was stirred for about 15 minuets, and about 1 M of NaOH was added into the slurry to adjust the pH to about 5. After mixing for an additional 20 minutes, the slurry was heated to about 96° C., and the pH of the slurry was adjusted to about 4.2 by the addition of about 0.3 M $HNO_3$ solution. After the adjustment of the pH, the slurry was coalesced for about 2.5 hours, and the toner particles thus obtained were collected by filtration. After washing and drying, the diameter of the resulting magenta toner particles was about 8.12 microns.

About 100 grams of the resulting emulsion aggregation magenta toner particles was blended with about 3 grams of the polymer-ionic charge control agent produced in Example 2, by a roll-mill at about 200 rpm for about 15 hours.

About 6 grams of the resulting blended particles were then added to about 100 grams of oxidized sponge iron carrier cores (about 90μ diameter) available from Hoeganaes Corporation and subjected to paint shaking. Three separate samples were prepared in this manner with varying times of paint shaking, i.e., the three samples were paint shaken for about 10 minutes, about 30 minutes and about 60 minutes, respectively. The triboelectric charge of the resulting particles was obtained by using a Faraday Cage blow off apparatus after conditioning the samples for about 24 hours to determine the charging behavior of the resulting particles: one sample was conditioned at about 20 percent relative humidity; the other sample was conditioned at about 80 percent relative humidity.

Comparative Example 1

For comparison with the polymer-ionic charge control agent of Example 2, about 100 grams of the same emulsion aggregation magenta toner particles of Example 3 was blended with about 3.5 grams of a silica/titania charge control agent (the ratio of silica to titania was about 4:1). About 6 grams of the blended particles was added to about 100 grams of oxidized sponge iron carrier cores (about 90μ diameter) available from Hoeganaes Corporation and subjected to paint shaking for about 10 minutes, about 30 minutes and about 60 minutes as described in Example 3 above. The triboelectric charge of the resulting particles was obtained as described in Example 3. Table 1 below provides a comparison of the test results of Example 3 and Comparative Example 1. These results are also graphically depicted in the FIGURE.

TABLE 1

| | Mixing Time, minutes | | |
|---|---|---|---|
| | 10 | 30 | 60 |
| Example 3, Triboelectric charge (μC/g) | 23.08 | 25.88 | 27.58 |
| Comparative Example 1, Triboelectric charge (μC/g) | 24.47 | 27.07 | 32.47 |

As can be seen from the data, toner with a polymer-ionic charge control agent of the present disclosure as prepared in Example 3 had a triboelectric charge of about 23.08 μC/g after about 10 minutes of shaking, and a triboelectric charge of about 27.58 μC/g after about 60 minutes of shaking. The change of triboelectric charging was about 4.5 μC/g. For comparison, the control toner particle prepared in Comparative Example 1 with silica/titania as a charge control agent had a triboelectric charge of about 24.47 μC/g after about 10 minutes of shaking, and a triboelectric charge of about 32.47 μC/g after about 60 minutes of shaking. The change of triboelectric charging for the control toner was thus about 8 μC/g.

As can be seen from the above data, the polymer-ionic charge control agents of the present disclosure provided emulsion aggregation toners with both high and stable triboelectric charging, which resulted in excellent imaging quality.

These results confirmed that the polymer-ionic complex of the present disclosure is an excellent charge control agent for emulsion aggregation toners, as the polymer-ionic complex efficiently enhanced the toner triboelectric charging and stabilized the triboelectric charging of an emulsion aggregation toner in a very short period of time, as compared to the control toner of Comparative Example 1.

Furthermore, the toner possessing the polymer-ionic complex charge control agent obtained a steady state of triboelectric charge in a very short time period as compared to the control, which had a triboelectric charge that was still rising.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner comprising:

a toner particle comprising a latex, a pigment, and an optional wax; and a charge control agent comprising a polymer-ionic complex comprising an ion selected from the group consisting of metallic ions and non-metallic ions, in combination with a polymeric ligand having an average molecular weight of from about 2000 to about 200000, the polymeric ligand comprising salicylic acid, in combination with a second component selected from the group consisting of formaldehyde and paraformaldehyde, and combinations thereof.

2. A toner as in claim 1, wherein the latex is selected from the group consisting of styrenes, acrylates, methacrylates, butadienes, isoprenes, acrylic acids, methacrylic acids, acrylonitriles, and combinations thereof, and the latex has a glass transition temperature from about 35° C. to about 75° C., and the pigment comprises a magenta pigment selected from the group consisting of Pigment Red 122, Pigment Red 185, Pigment Red 192, Pigment Red 202, Pigment Red 206, Pigment Red 235, Pigment Red 269, and combinations thereof.

3. A toner as in claim 1, wherein the metallic ion is zinc.

4. A toner comprising:

a toner particle comprising a latex, a magenta pigment, and an optional wax; and a charge control agent comprising a polymer-ionic complex comprising an ion selected from the group consisting of metallic ions and non-metallic ions, in combination with a polymeric ligand having an average molecular weight of from about 2000 to about 200000, the polymeric ligand comprising salicylic acid, in combination with an aldehyde selected from the group consisting of formaldehyde, paraformaldehyde, and combinations thereof.

5. A toner as in claim 4 wherein the latex is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylateisoprene), poly(methyl acrylate-isoprene), poly(ethyl acrylate-isoprene), poly(propyl acrylate-isoprene), poly(butyl acrylate-isoprene), poly(styrene-butylacrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and combinations thereof, and the pigment comprises a magenta pigment selected from the group consisting of Pigment Red 122, Pigment Red 185, Pigment Red 192, Pigment Red 202, Pigment Red 206, Pigment Red 235, Pigment Red 269, and combinations thereof.

6. A toner as in claim 4 wherein the metallic ion is zinc, and wherein the polymer-ionic complex is present in an amount from about 0.01 to about 10 weight percent of the toner.

7. A toner comprising:

a toner particle comprising a latex, a pigment, and an optional wax; and a charge control agent comprising a polymer-ionic complex comprising a metallic ion comprising zinc, in combination with a polymeric ligand having an average molecular weight of from about 2000 to about 200000, the polymeric ligand comprising an acid comprising salicylic acid, in combination with a second component comprising an aldehyde comprising formaldehyde.

8. A toner as in claim 7, wherein the latex is selected from the group consisting of styrenes, acrylates, methacrylates, butadienes, isoprenes, acrylic acids, methacrylic acids, acrylonitriles, and combinations thereof, and the latex has a glass transition temperature from about 35° C. to about 75° C., and the pigment comprises a magenta pigment selected from the group consisting of Pigment Red 122, Pigment Red 185, Pigment Red 192, Pigment Red 202, Pigment Red 206, Pigment Red 325, Pigment Red 269, and combinations thereof.

9. A toner as in claim 1, wherein the polymer-ionic complex comprises the following formula:

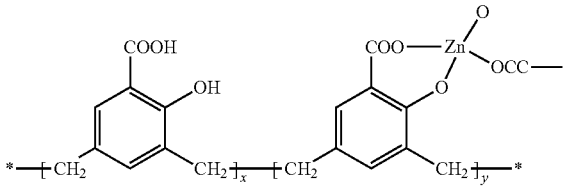

wherein x is a number from about 5 to about 1000 and y is a number from about 5 to about 1000.

* * * * *